US010711497B2

(12) United States Patent
Lang

(10) Patent No.: US 10,711,497 B2
(45) Date of Patent: Jul. 14, 2020

(54) SLIDING PANEL WHEEL ASSEMBLY

(71) Applicant: MAMMOTH INDUSTRIES PTY LTD, Thomastown, Victoria (AU)

(72) Inventor: Craig Lang, Thomastown (AU)

(73) Assignee: MAMMOTH INDUSTRIES PTY LTD, Thomastown, Victoria (AU)

( * ) Notice: Subject to any disclaimer, the term of this patent is extended or adjusted under 35 U.S.C. 154(b) by 36 days.

(21) Appl. No.: 15/692,434

(22) Filed: Aug. 31, 2017

(65) Prior Publication Data

US 2018/0058122 A1 Mar. 1, 2018

(30) Foreign Application Priority Data

Aug. 31, 2016 (AU) ..... 2016903461

(51) Int. Cl.
*E05D 15/06* (2006.01)
*E05D 15/10* (2006.01)
*E06B 3/46* (2006.01)

(52) U.S. Cl.
CPC ..... *E05D 15/0665* (2013.01); *E05D 15/0669* (2013.01); *E05D 15/10* (2013.01); *E06B 3/46* (2013.01); *E05Y 2201/64* (2013.01); *E05Y 2201/674* (2013.01); *E05Y 2201/688* (2013.01); *E05Y 2600/312* (2013.01); *E05Y 2900/142* (2013.01)

(58) Field of Classification Search
CPC ..... E05D 15/0069; E05D 15/066; E05D 15/0665; E05Y 2201/64; E05Y 2201/674; E05Y 2201/688; E05Y 2600/312; Y10T 16/35; Y10T 16/3834
See application file for complete search history.

(56) References Cited

U.S. PATENT DOCUMENTS 1,370,037 A * 3/1921 Morin ..... E05D 15/0634 16/104
3,040,391 A * 6/1962 Saunders ..... B60B 33/06 16/105
3,137,028 A * 6/1964 Steigerwald ..... E05D 15/0669 16/105
3,167,112 A * 1/1965 Tucker ..... E05D 15/066 16/105
3,208,109 A * 9/1965 Buck, Jr. ..... E05D 15/0669 16/105
3,237,238 A * 3/1966 Anderson ..... E05D 15/0669 16/100
3,298,136 A * 1/1967 Saunders ..... E05D 15/0669 16/105

(Continued)

*Primary Examiner* — Johnnie A. Shablack
(74) *Attorney, Agent, or Firm* — David D. Brush; Westman, Champlin & Koehler, P.A.

(57) ABSTRACT

The present invention provides a wheel assembly having an elongate housing configured to engage with and support a sliding panel element. The housing has a first subassembly having a first pair of wheels, the first subassembly being configured so as to allow rocking of the first pair of wheels. The housing also has a second subassembly having a second pair of wheels, the second subassembly being configured so as to allow rocking of the second pair of wheels. The first and second subassemblies are independently vertically adjustable with reference to the housing. The present wheel assemblies may be of the type used to support a sliding door or similar, on a surface such as a track.

11 Claims, 4 Drawing Sheets

(56) References Cited

U.S. PATENT DOCUMENTS 3,512,209 A * 5/1970 Povoden ..... E05D 15/0669 16/105
3,517,459 A * 6/1970 Schupper ..... E05D 15/0665 16/91
3,613,313 A * 10/1971 Helmick ..... E05D 15/0669 16/91
3,670,357 A * 6/1972 Steigerwald ..... E05D 15/0669 16/100
3,696,560 A * 10/1972 Hallin ..... E05D 15/0634 16/105
3,716,890 A * 2/1973 Benson ..... A47H 15/00 16/91
3,748,784 A * 7/1973 Smits ..... E05D 15/0669 16/105
3,996,643 A * 12/1976 Steigerwald ..... E05D 15/0669 16/99
4,014,073 A * 3/1977 Uehara ..... E05D 15/0669 16/105
4,064,592 A * 12/1977 Riegelman ..... E05D 15/0669 16/100
4,194,266 A * 3/1980 Natzel ..... E05D 15/0669 16/32
4,262,451 A * 4/1981 Dallaire ..... E05D 15/0669 16/105
4,282,631 A * 8/1981 Uehara ..... E05D 15/0665 16/102
4,404,771 A * 9/1983 Murase ..... E05D 15/0669 16/105
4,633,615 A * 1/1987 Moose ..... E05D 15/0669 16/100
4,850,078 A * 7/1989 Libby ..... E05D 15/0669 16/100
5,018,306 A * 5/1991 Prevot ..... E05D 15/06 49/425
5,488,803 A * 2/1996 George ..... E05D 15/066 16/100
5,546,706 A * 8/1996 Coupet ..... E05D 15/0669 16/105
5,791,089 A * 8/1998 Prevot ..... E05D 15/0669 49/425
5,860,189 A * 1/1999 An ..... E05D 15/0669 16/105
5,950,279 A * 9/1999 Chaput ..... A47H 1/08 16/105
5,964,061 A * 10/1999 Hughes ..... E05D 15/0669 49/403
6,021,547 A * 2/2000 Stagoll ..... E05D 15/0669 16/105
6,526,625 B2 * 3/2003 Becken ..... E05D 15/0669 16/105
6,588,061 B2 * 7/2003 Becken ..... E05D 15/0669 16/105
7,770,329 B2 * 8/2010 Hutnik ..... E05D 15/0669 49/410
7,849,560 B2 * 12/2010 Kelley ..... E05D 15/066 16/105
7,891,052 B2 * 2/2011 Haab ..... E05D 15/0634 16/105
8,490,331 B2 * 7/2013 Quesada ..... E05D 15/0665 16/18 R
9,080,359 B2 * 7/2015 Horwood ..... E05D 15/0669
9,085,924 B2 * 7/2015 Tidwell ..... E05D 15/0669
9,879,458 B2 * 1/2018 Gabriel ..... E05D 15/0652
9,879,460 B2 * 1/2018 Nilsson ..... E05F 5/003
2005/0011041 A1 * 1/2005 Ness ..... E05D 15/0669 16/105
2005/0012816 A1 * 1/2005 Becken ..... E05D 15/0665 348/107
2007/0130725 A1 * 6/2007 Ness ..... E05D 15/0669 16/105
2014/0290001 A1 * 10/2014 Hasegawa ..... B62B 5/0086 16/45
2018/0058122 A1 * 3/2018 Lang ..... E05D 15/0665
2018/0283070 A1 * 10/2018 Hamilton ..... E05D 15/0634

* cited by examiner

SLIDING PANEL WHEEL ASSEMBLY

FIELD OF THE INVENTION

The present invention relates to the field of wheel assemblies of the type used to support a sliding door or similar, on a surface such as a track.

BACKGROUND TO THE INVENTION

Sliding elements are well known and have been used in building construction for many years. For example, a patio or porch may have a sliding door separating the outdoor from the indoor. Such doors typically have a frames fabricated from a metal profiles and inlaid with either glass, an opaque panel or an insect screen. Another example of a sliding element is a wall panel which can be mobilised in a sliding manner so as to divide a room into smaller areas.

A sliding element is typically mounted on wheels or rollers which are dimensioned to roll within a guide track or may be grooved to roll on a rail. In some circumstances, each sliding element has two or more wheels which are mounted in a housing of some description. The housing (with wheels) is received in a cavity present in a lower edge of the sliding element such that the element is supported by, and rollable upon, the wheels.

It has been recognised in the prior art that adjustment means are often necessary so as to allow for the vertical adjustment of the sliding element with reference to the substrate (be it track, rail or floor). For example, it may be necessary to increase the height of the panel above a track such that the lower edge of the panel clears the upper edge of the track so as to allow the wheels to support the weight of the element and roll freely. As another example, where a sliding element has two sets of wheels and the substrate is not even or the panel is not properly vertically aligned it may be necessary to differentially adjust the height of the wheels. The aim of this adjustment is to allow the wheels to roll freely and to also evenly distribute the load across all wheels.

Prior art wheel assemblies having multiple wheels are difficult or impossible to adjust such that load is evenly spread across all wheels, and each wheel is adjusted vertically to a required level. Where load is not evenly spread, a wheel assuming a disproportionally large load may prematurely fail due to the extras forces applied thereto. Where each wheel is not set the appropriate height, the element may not slide smoothly and may impact on a track edge.

It is an aspect of the present invention to overcome or alleviate a problem of the prior art by providing a sliding element wheel assembly which is an improvement over prior art wheel assemblies with respect to the ability or the ease to vertically adjust wheels within the assembly and/or evenly distribute load across all wheels. It is a further aspect to provide an alternative to prior art wheel assemblies.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not normally the broadest aspect, the present invention provides a wheel assembly comprising an elongate housing configured to engage with and support a sliding panel element, the housing comprising: a first subassembly having a first pair of wheels, the first subassembly being configured so as to allow rocking of the first pair of wheels, a second subassembly having a second pair of wheels, the second subassembly being configured so as to allow rocking of the second pair of wheels, wherein the first and second subassemblies are independently vertically adjustable with reference to the housing.

In one embodiment of the first aspect, the wheel assembly comprises an elongate carriage configured to be at least partially located inside the housing, the carriage configured to move vertically relative to the housing, the carriage being configured to support the first subassembly and the second subassembly, the carriage being further configured so as to be capable of forming a variable angle to the longitudinal axis of the housing.

In one embodiment of the first aspect the first and second subassemblies each comprise a support member extending therefrom, and the housing comprises two support surfaces wherein each of the support members is supported by a support surface.

In one embodiment of the first aspect, the support member extending from the first subassembly is disposed half way between the wheels of the first subassembly, and the support member extending from the second subassembly is disposed half way between the wheels of the second subassembly.

In one embodiment of the first aspect, each of the support members form a pivot about which the two wheels of each subassembly rock.

In one embodiment of the first aspect, one or both of the support surfaces is a slot formed in the housing.

In one embodiment of the first aspect the slots are elongate and (i) parallel to the longitudinal axis of the housing, and (ii) inclined at an angle to the longitudinal axis of the housing.

In one embodiment of the first aspect, both of the support surfaces are a slot and both slots are inclined at substantially the same angle and angled in substantially the same direction to each other.

In one embodiment of the first aspect, the carriage comprises a first slot and a second slot, the support member extending from the first subassembly and through the first carriage slot to one of the two support surfaces, and the support member extending from the second subassembly extends through the second carriage slot to the other of the two support surfaces.

In one embodiment of the first aspect, the first carriage slot is inclined at the opposite angle to the first housing slot, and the second carriage slot is inclined at the opposite angle to the second carriage slot.

In one embodiment of the first aspect, the first and second housing slots are angled upwardly from left to right, and the first and second carriage slots are angled downwardly left to right.

In one embodiment of the first aspect, the wheel assembly comprises adjusting means configured to adjust the vertical distance between the lowest point of the housing and the lowest point of the wheels.

In one embodiment of the first aspect, the adjusting means comprises a threaded member extending through the housing and the carriage has a nut affixed thereto, the threaded member engaging with the nut, wherein upon screwing the threaded member inwardly the first and second sub-assemblies travel upwardly along the support surfaces.

In a second aspect, the present invention provides a sliding panel comprising the wheel assembly of the first aspect, wherein the wheel assembly is engaged with a lower region of the sliding panel such that all wheels of the wheel assembly a capable of supporting the sliding panel above an underlying surface.

In a third aspect, the present invention provides a kit comprising the sliding panel of the second aspect and a track configured to guide the wheels of the wheel assembly.

In a fourth aspect, the present invention provides a sliding panel installation comprising the wheel assembly of the second aspect and a track configured to guide the wheels of the wheel assembly, the track disposed on an underlying surface.

DETAILED DESCRIPTION OF THE INVENTION INCLUDING PREFERRED EMBODIMENTS

Figure 1:
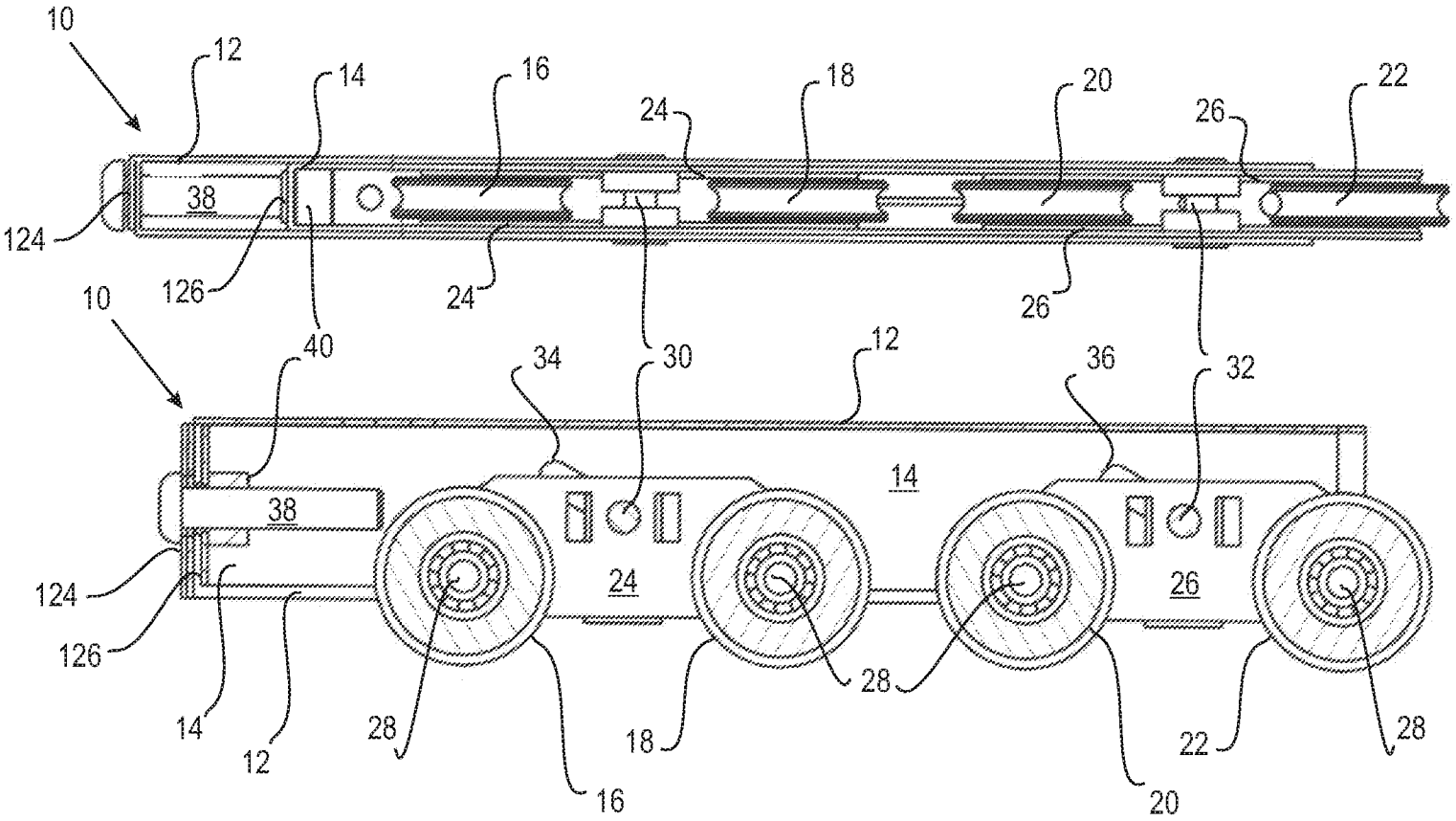
FIG. 1 shows a preferred wheel assembly of the present invention. The upper drawing shows a view from the lower side, with the lower drawing showing a lateral cross-sectional view. The upper drawing shows the assembly set to minimum vertical height adjustment (i.e. minimum clearance between the lower edge of a door and an underlying sill), with the lower drawing showing maximum vertical height adjustment (i.e. the maximum clearance between the lower edge of a door and an underlying sill).

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects may lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and from different embodiments, as would be understood by those in the art.

In the claims below and the description herein, any one of the terms "comprising", "comprised of" or "which comprises" is an open term that means including at least the elements/features that follow, but not excluding others. Thus, the term comprising, when used in the claims, should not be interpreted as being limitative to the means or elements or steps listed thereafter. For example, the scope of the expression a method comprising step A and step B should not be limited to methods consisting only of methods A and B. Any one of the terms "including" or "which includes" or "that includes" as used herein is also an open term that also means including at least the elements/features that follow the term, but not excluding others. Thus, "including" is synonymous with and means "comprising".

It is not represented that all embodiments of the invention have all advantages described, nor that any particular embodiment has all advantages. Some embodiments of the invention may have only a single advantage. Other embodiments may provide no advantage whatsoever and are merely a useful alternative to the prior art.

The present invention is predicated at least in part on Applicant's finding that the load of a sliding panel bearing on a wheel assembly supporting the panel can be spread more evenly across the wheels where two pairs of wheels are used, and whereby each of the wheels are capable of independently assuming variable vertical dispositions with reference to a housing of the wheel assembly. By this arrangement, the housing (which typically acts to support the sliding panel) may be vertically adjustable with reference to the wheels and therefore able to be angled freely thereby allowing for (i) each wheel to make contact with and transfer load to an underlying surface and (ii) the housing to the angled such that the vertical axis of the panel can be angled with reference to the underlying surface. Thus, where an underlying surface (such as a floor or a track) is not level, the sliding panel can be nevertheless installed level whilst still allowing for each wheel of the wheel assembly to assume substantially equals loads, and to transfer those equal loads to the underlying surface.

Significant advantage is provided in terms of operation given that a panel is able to be installed with sufficient clearance being maintained between the lower edge of the panel and the underlying surface. This allows for the panel to slide across an underlying surface which is not level, with the lower edge of the panel maintaining sufficient clearance. Moreover, longevity of the wheel assembly is improved given that all wheels are able to contact the underlying surface and therefore any one of the wheels is not subjected to excessive loads due to any lack of contact of another wheel with the underlying surface.

In a first aspect, the present invention provides a wheel assembly comprising an elongate housing configured to engage with and support a sliding panel element, the housing comprising: a first subassembly having a first pair of wheels, the first subassembly being configured so as to allow rocking of the first pair of wheels, a second subassembly having a second pair of wheels, the second subassembly being configured so as to allow rocking of the second pair of wheels, wherein the first and second subassemblies are independently vertically adjustable with reference to the housing.

In one embodiment, the wheel assembly comprises an elongate carriage configured to be at least partially located inside the housing, the carriage configured to move vertically relative to the housing, the carriage being configured to support the first subassembly and the second subassembly, the carriage being further configured so as to be capable of forming a variable angle to the longitudinal axis of the housing.

The present wheel assembly is capable of adapting to installations that depart from the ideal. As will be understood, for example in an ideal installation of a sliding door the underlying surface on which the door slides is precisely horizontal. Furthermore, the long axis of the door is disposed precisely vertically, and the door requires no vertical adjustment. The present wheel assembly is configured to allow for any departure from this ideal in installation, and can be adapted accordingly to compensate.

Reference is made to FIG. 1 which shows a highly preferred embodiment of the invention showing the wheel assembly 10 having an external housing 12 and a carriage 14. The external surface of the carriage 14 is sliding engagement with the internal surface of the housing 12 so as to allow the carriage 14 to move vertically and horizontally within the housing 12. Little or no free play is allowed such that the housing 12 acts to closely guide the movement of the carriage 14. The carriage 14 is shown in the drawing to be completely contained within the confines of the housing 12, however as will become apparent infra, upon adjustment of the wheel assembly the carriage 14 may extend beyond the confines of the housing 12.

Both housing 12 and carriage 14 are open along their lower sides so as to allow the wheels 16, 18, 20 and 22 to protrude and therefore free to make contact with and roll over an underlying surface. By this arrangement, the carriage 14 is permitted to slide downwardly and extend beyond the lower edge of the housing 12.

Both housing 12 and carriage 14 are open along their right lateral edges (as drawn). This allows for the carriage 14 to slide laterally and extend beyond the right lateral edge of the housing 12.

Both housing 12 and carriage 14 are substantially closed along their left lateral edges (as drawn) to form lateral faces (marked 124 and 126 respectively). Each of the lateral faces 124 and 126 comprise an aperture (not marked) allowing for the passage of an adjusting screw 38, the operation which is further described infra.

While the housing 12 and carriage 14 are drawn in FIG. 1 as having parallel longitudinal axes, these parts are engaged in a manner allowing the housing 12 to be angled to the carriage 14 (or vice-versa). Typically, the wheel assembly 10 is fitted into a lower region of a sliding panel (not shown) such that the housing is parallel to the lateral axis (normally the short axis) of the panel. Thus, the housing 12 may be considered as permanently fixed to the panel, with the carriage 14 therefore capable of being angled to the lateral axis of the panel. By this arrangement, the lateral axis of the panel may be maintained strictly horizontal while the carriage is angled to the horizontal.

The wheel assembly comprises a first subassembly 24 and a second subassembly 26. The first subassembly 24 supports a first pair of wheels 16 and 18, and the second subassembly 26 supports a second pair of wheels 20 and 22. The wheels 16, 18, 20 and 26 are mounted on the subassemblies 24 and 26 by axles 28.

The first subassembly 24 and a second subassembly 26 are each engaged with the housing 12 be way of pins 30 and 32. The pins 30 and 32 form the further function of acting as a pivot point about which each of the subassemblies 24 and 26 respectively may rock. For example, the subassembly 24 may pivot about the pin 30 such that the wheels 16 and 18 are level (as drawn in FIG. 1), or the wheel 16 being higher than the wheel 18, or the wheel 18 being higher than the wheel 16. Similarly, the subassembly 26 may pivot about the pin 32 such that the wheels 20 and 22 are level (as drawn in FIG. 1), or the wheel 20 being higher than the wheel 22, or the wheel 22 being higher than the wheel 20. In this way, irrespective of any angling (or lack of angling) of the housing 12 and/or the carriage 14 each of the wheels 16, 18, 20 and 22 are capable of contacting an underlying surface and assuming equal load.

It will be noted form FIG. 1 that each wheel 16, 18, 20, and 22 can assume different vertical positions. Typically, however, the wheels 16, 18, 20 and 22 will assume a substantially linear arrangement in accordance with a substantially planar underlying surface. Upon the wheel assembly assuming the load of a sliding panel, each of the first and second subassemblies pivot about the pins 30 and 32 respectively thereby allowing each of the wheels 16, 18, 20 and 22 to automatically assumes a position in which it contacts the underlying surface and assumes an equal share of the load.

In addition to the pivoting function described supra, the present wheel assembly is capable of further adaptation to compensate for installations that depart from the ideal. The wheel assembly 10 is not only height adjustable (so as to adjust clearance of the lower edge of the sliding panel from an underlying surface), but also differentially height adjustable such that one end of the housing has a greater vertical distance between it and an underlying surface, than the other end. This allows for a sliding door supported by the wheel assembly to be tilted laterally about its long axis such that the lower edge of the wheels can remain in contact with an underlying surface while the sliding door is slightly titled. In this way, where the angle between a vertical member of a door frame and the underlying surface is not 90 degrees, the door edge can still form a flush seal with the vertical member while the wheels remain in contact with the underlying surface. This tilting is allowed while at the same time providing for overall height adjustability.

The ability to adjust the height of the sliding panel is provided in the preferred embodiment of FIG. 1 by the angled slots 34 and 36 in the housing 12. The angled slots provide support surfaces which act to support the pins 30 and 32 respectively. Given that the pins 30 and 32 support the subassemblies 24 and 26 respectively, and the subassemblies 24 and 26 in turn support the wheels 16, 18 and 20, 22 respectively, it will be appreciated that movement of the pins 30 and 32 along the slots 34 and 36 respectively results in a change in the vertical height of the wheels.

The ability to differentially adjust the height of the sliding panel to allow for lateral tilting results from the ability of the carriage 14 to be angled with reference to the housing 12. When angled, the respective positions of each pin 30 or 32 in its respective slot 34 or 36 will be different. For example, where the upper edge of the carriage is horizontal and the housing is inclined downwardly from left to right the pin 30 is in a relatively low position along the angled slot 34 and the pin 32 has travelled further along the angled slot 36 and is in a relatively high position along the angled slot 36. Thus, the load applied to the wheel assembly by a tilted sliding panel causes the pins 30 and 32 to travel differential distances along the slots 34 and 36 respectively thereby compensating for the tilt of the sliding panel with reference to an underlying surface.

Once the tilt has been compensated for in this way, the overall vertical position of the panel can be adjusted by moving the carriage 14 to the left (as drawn in FIG. 1) to move upwardly, or to the right to move downwardly. It will be understood that in the process of the overall vertical adjustment of the panel, the pins 30 and 32 will move the same distances along their respective slots 34 and 36 so as to maintain the required tilt.

Movement of the carriage 14 left and right so as to adjust height is achieved in the preferred embodiment of FIG. 1 using a bolt 38 in threaded engagement with a nut 40 attached to lateral face 126 of the carriage 14. Thus, winding the bolt clockwise or counter-clockwise causes lateral movement of the carriage. An aperture 42 is provided in the lateral face 124 of the housing 12 to allow the threaded shank of the bolt to extend therethrough yet does not allow for passage of the head. Thus, the bolt head remains in contact with the lateral face 124 while winding with the rotating bolt shank causing the lateral movement of the carriage 14. The aperture is in the form of a vertically oriented slot given that the bolt 38 is free to move upwardly and downwardly in accordance with any tilting of the housing 12 relative to the carriage 14 to which the bolt 38 is engaged.

The upper drawing of FIG. 1 shows the arrangement where the bolt 38 is rotated counter-clockwise so as to urge the lateral face 126 of the carriage 14 away from the lateral face 124 of the housing 12. In this circumstance the pins 30 and 32 are relatively low in the angled slots 34 and 36 respectively this causing the housing (and therefore a sliding panel) to be lifted well above the surface underlying the wheels 16, 18, 20, 22. It will noted that the carriage 14 and subassembly 26 extend laterally outside the housing 12.

The lower drawing of FIG. 1 shows the arrangement where the bolt 38 is rotated fully clockwise so as to draw the lateral face 126 of the carriage 14 toward the lateral face 124 of the housing 12. In this circumstance the pins 30 and 32 are relatively high in the angled slots 34 and 36 respectively this causing the housing (and therefore a sliding panel) to be lowered as compared with the situation shown in the upper drawing. It will noted that the carriage 14 and subassembly 26 are contained completely within the confines of the housing 12.

Figure 2:
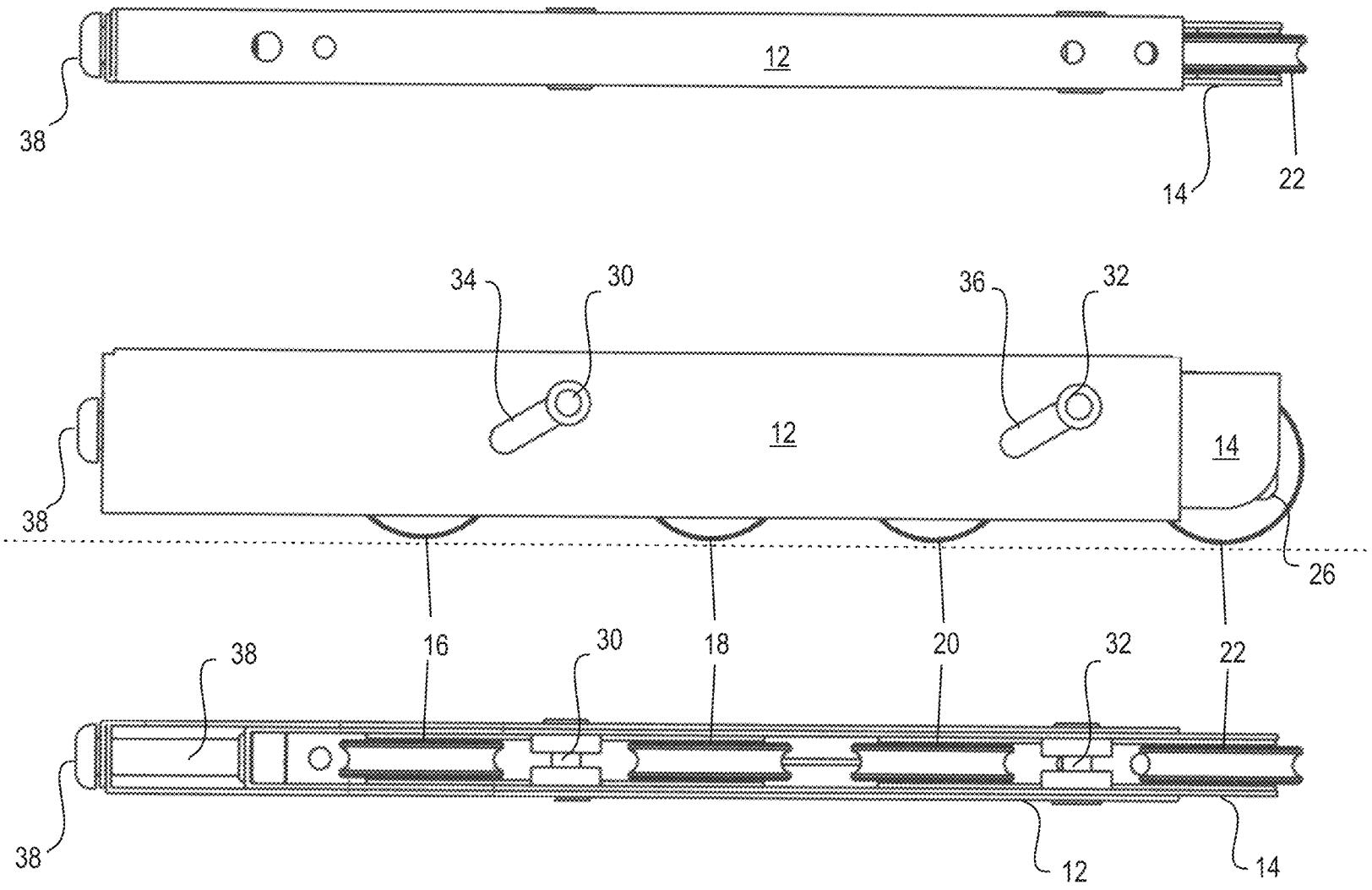
FIG. 2 shows the preferred wheel assembly as shown in FIG. 1, and adjusted as shown in the upper drawing (i.e. with maximum vertical height adjustment). The uppermost drawing shows a plan view revealing the upper face of the housing. The middle drawing shows a lateral view and the lower drawing shows a view from the lower side.

Referring now to FIG. 2 there is shown the same wheel assembly adjusted in the same manner as that shown in the upper drawing of FIG. 1. The middle drawing shows more clearly the pins 30 and 32 fully traveled to the upper regions of the slots 34 and 36. This has the effect of drawing the wheels 16, 18, 20, 22 upwards thereby lowering the distance between the lower edge of the housing 12 and an underlying surface (represented by the broken line beneath the wheels).

Figure 3:
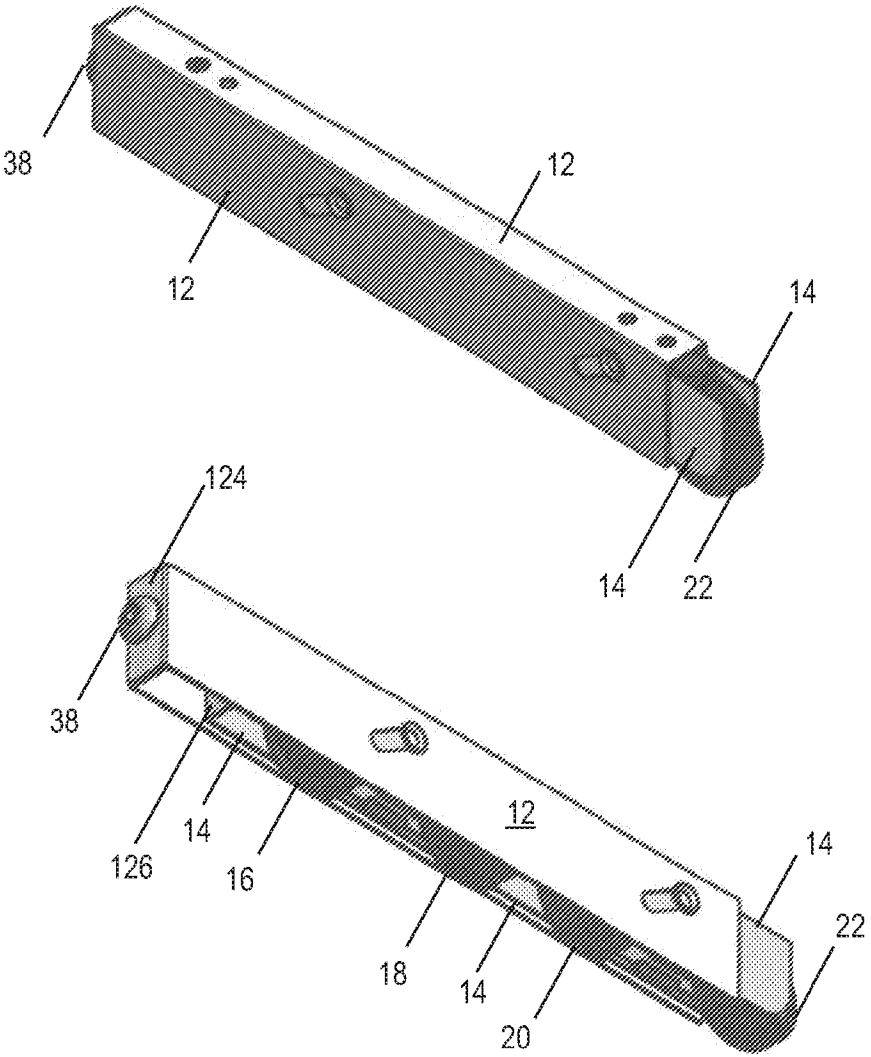
FIG. 3 shows two perspective views of the wheel assembly shown as adjusted in FIG. 2.

FIG. 3 shows end perspective views the same wheel assembly adjusted in the same manner as that shown in the upper drawing of FIG. 1. These view show clearly the substantially closed nature of the lateral faces 124 of the housing 12, and the open nature of the opposing end of the housing 12 so as to allow extension of the carriage 14 beyond the confines of the housing 12.

Figure 4B:
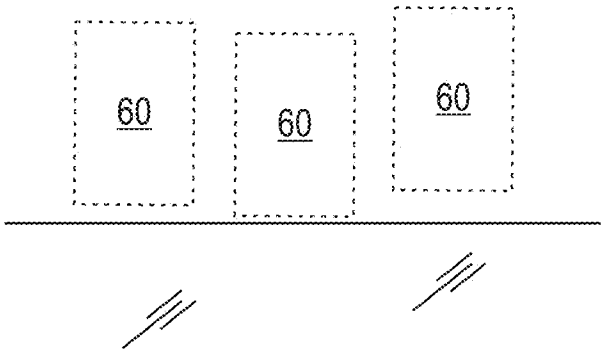
FIGS. 4B and 4C shows in exaggerated form possible adjustments to the height of the door and titling of the door by use of the present wheel assembly.
Figure 4C:
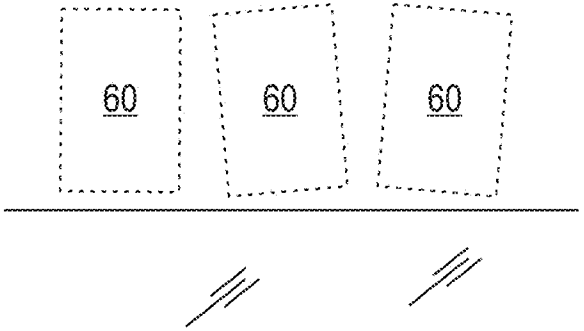
Figure 4A:
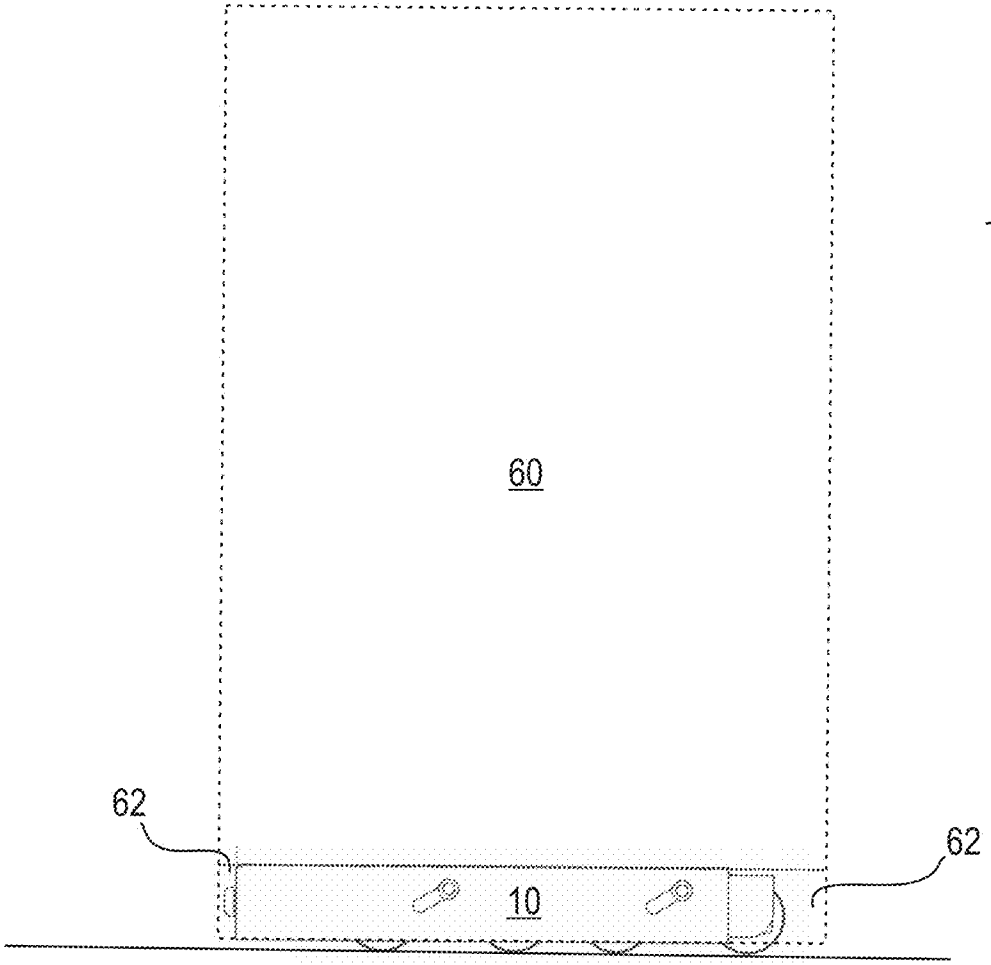
FIG. 4A shows a preferred wheel assembly installed in a cavity of the lower edge of a door.

FIG. 4A shows a wheel assembly of the present invention installed in a cavity 62 of a sliding door 60. The wheel assembly can be adjusted to increase and decrease the height of the door (FIG. 4A) and/or alter the tilt angle of the door (FIG. 4B).

The present invention has been described primarily by reference to a sliding door. It will be appreciated immediately by the skilled person that the invention will find utility for other applications in building construction such as sliding room dividers, sliding walls and the like. The invention may find utility for supporting rolling platforms for which adjustment of height and/or tilt is required.

In the description provided herein, numerous specific details are set forth. However, it is understood that embodiments of the invention may be practiced without these specific details. In other instances, well-known methods, structures and techniques have not been shown in detail in order not to obscure an understanding of this description.

In the following claims, any of the claimed embodiments can be used in any combination.

The invention claimed is:

1. A wheel assembly comprising:

(i) an elongate housing configured to engage with and support a sliding panel element, the housing comprising first and second inclined support surfaces that are inclined in the same direction and in spaced relation to each other along the elongate housing, (ii) an elongate carriage at least partially located inside the housing, (iii) a first support member supporting a first wheel subassembly within the elongate carriage and configured to rest on the first inclined support surface, (iv) a second support member supporting a second wheel subassembly within the elongate carriage and configured to rest on the second inclined support surface, wherein the first and second support members are movable along the first and second inclined surfaces respectively so as to raise and lower the elongate housing with respect to the elongate carriage, and wherein the first and second support members are positionable along the first and second inclined surfaces respectively so as to allow a long axis of the elongate carriage to form an angle with the long axis of the elongate housing such that wheels of the first and second subassemblies are independently vertically adjustable with reference to the housing.

2. The wheel assembly of claim 1 wherein the first wheel subassembly has first and second wheels and the the first support member is disposed half way between the first and second wheels of the first subassembly, and the second subassembly has first and second wheels and the second support member is disposed half way between the first and second wheels of the second subassembly.

3. The wheel assembly of claim 2 wherein each of the support members form a pivot about which each wheel subassembly rocks.

4. The wheel assembly of claim 1 wherein one or both of the first and second inclined support surfaces of the housing is a slot formed in the housing.

5. The wheel assembly of claim 4 wherein the slot is elongate and (i) parallel to the longitudinal axis of the housing, and (ii) inclined at an angle to the longitudinal axis of the housing.

6. The wheel assembly of claim 5 wherein both of the first and second support surfaces are a slot and both slots are inclined at substantially the same angle and angled in substantially the same direction to each other.

7. A sliding panel comprising the wheel assembly of claim 1, wherein the wheel assembly is engaged with a lower region of the sliding panel such that all wheels of the wheel assembly are capable of supporting the sliding panel above an underlying surface.

8. A kit comprising the sliding panel of claim 7 and a track configured to guide the wheels of the wheel assembly.

9. A sliding panel installation comprising the sliding panel of claim 7 and a track configured to guide the wheels of the wheel assembly, the track disposed on an underlying surface.

10. The wheel assembly of claim 1 comprising an adjustment mechanism configured to adjust the vertical distance between the lowest point of the housing and the lowest point of the wheels.

11. The wheel assembly of claim 1, comprising an adjustment mechanism configured to adjust the vertical distance between the lowest point of the housing and the lowest point of the wheels, wherein the adjustment mechanism comprises a threaded member extending through the housing and the carriage has a nut affixed thereto, the threaded member engaging with the nut, wherein upon screwing the threaded member inwardly the first and second subassemblies travel upwardly along the support surfaces.

* * * * *